US006155800A

United States Patent [19]

Todescat et al.

[11] Patent Number: 6,155,800

[45] Date of Patent: Dec. 5, 2000

[54] SUCTION ARRANGEMENT FOR A RECIPROCATING HERMETIC COMPRESSOR

[75] Inventors: Márcio Luiz Todescat; Dietmar Erich Bernhard Lilie; Fabian Fagotti, all of Joinville-SC, Brazil

[73] Assignee: Empresa Brasileira de Compressores S/A-Embraco, Joinville-SC, Brazil

[21] Appl. No.: 09/180,562

[22] PCT Filed: May 7, 1997

[86] PCT No.: PCT/BR97/00017

§ 371 Date: Nov. 25, 1999

§ 102(e) Date: Nov. 25, 1999

[87] PCT Pub. No.: WO97/43547

PCT Pub. Date: Nov. 20, 1997

[30] Foreign Application Priority Data

May 10, 1996 [BR] Brazil ..... 9601662

[51] Int. Cl.[7] ..... F04B 39/00

[52] U.S. Cl. ..... 417/312; 417/902; 181/403

[58] Field of Search ..... 417/312, 902; 181/403

[56] References Cited

U.S. PATENT DOCUMENTS

| | | | |
|---|---|---|---|
| 4,242,056 | 12/1980 | Dyhr et al. | 417/363 |
| 4,730,695 | 3/1988 | Bar | 181/252 |
| 4,990,067 | 2/1991 | Sasano et al. | 417/312 |
| 5,252,035 | 10/1993 | Lee | 417/312 |
| 5,451,727 | 9/1995 | Park | 181/229 |
| 5,641,949 | 6/1997 | Yeo | 181/229 |
| 5,703,336 | 12/1997 | Tark et al. | 181/179 |
| 5,988,990 | 11/1999 | Lee | 417/312 |

FOREIGN PATENT DOCUMENTS

| | | |
|---|---|---|
| 0 181 019 | 5/1986 | European Pat. Off. . |
| 0 411 195 | 2/1991 | European Pat. Off. . |
| 36 43 567 | 7/1987 | Germany . |

OTHER PUBLICATIONS

Patent Abstracts of Japan vol. 013, No. 582 (M–911), Dec. 21, 1989 and JP 01244180, Sep. 28, 1989.

International Preliminary Examination Report received in respect of International Application PCT/BR97/00017 dated Jul. 22, 1998.

*Primary Examiner*—Charles G. Freay
*Assistant Examiner*—Robert Z. Evora
*Attorney, Agent, or Firm*—Darby & Darby

[57] ABSTRACT

A section arrangement for a reciprocating hermetic compressor, includes a hermetic shell (21), a suction inlet tube (28) for gas admission and a suction orifice **(24*a*) at the head of a cylinder (22) disposed inside the shell (21) and which is in fluid communication with the suction inlet tube (28). A suction duct (60) has a first end (61) and a second end (62), which are hermetically coupled to the suction inlet tube (28) and suction orifice (24*a*), respectively, in order to conduct low pressure gas from the suction inlet tube (28) directly to the suction orifice (24*a*) and to provide thermal and acoustic insulation to the gas flow being drawn. At least one pressure equalizing element (70) provides a predetermined fluid communication of the gas being drawn between the suction inlet tube (28) and the suction orifice (24*a*) into the shell (21) and maintains the thermal and acoustic insulating characteristics of the suction duct (60)** substantially unaltered.

14 Claims, 3 Drawing Sheets

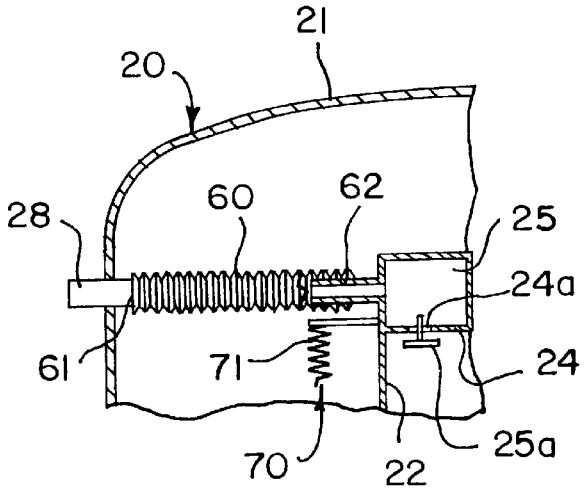
FIG. 3
FIG. 4
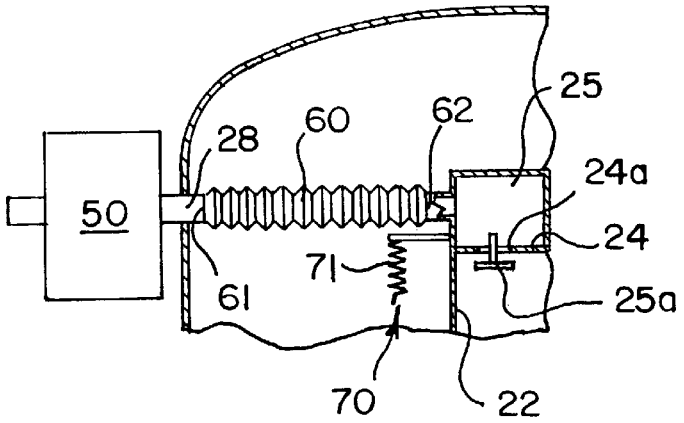
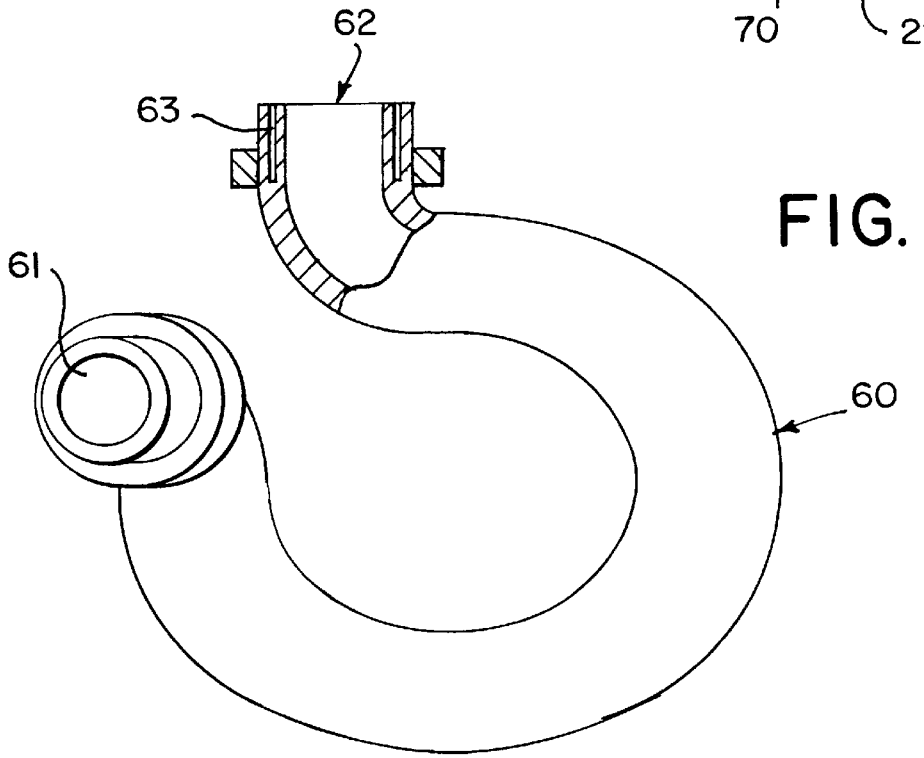
FIG. 6

SUCTION ARRANGEMENT FOR A RECIPROCATING HERMETIC COMPRESSOR

CROSS-RELATED APPLICATION

This application is a 371 of PCT/BR97/00017 filed on May 7, 1997.

FIELD OF THE INVENTION

The present invention refers to a suction arrangement for a reciprocating hermetic compressor of the type having low pressure within its hermetic shell.

BACKGROUND OF THE INVENTION

Reciprocating hermetic compressors are generally provided with suction acoustic dampening systems (acoustic filters), which are disposed inside the shell with the function to attenuate the noise generated during the suction of the refrigerant fluid. Such components, however, cause losses both in the refrigerating capacity and in the efficiency of the compressor, resulting from gas overheating and flow restriction. The manufacture of said filters from plastic materials have meant a significant advance regarding their optimization, although a considerable amount of the compressor losses is still due to this component.

In reciprocating compressors, the movement of the piston and the use of suction and discharge valves, which open only during a fraction of the total cycle, produce a pulsing gas flow both in the suction and in the discharge lines. Such flow is one of the causes of noise, which may be transmitted to the environment in two forms: by the excitement of the ressonance frequencies of the inner cavity of the compressor, or of other component of the mechanical assembly, or by the excitement of the ressonance frequencies of the piping of the refrigerant system, i.e., evaporator, condenser and connecting tubes of these components of the compressor refrigerating system. In the first case, the noise is transmitted to the shell, which irradiates it to the external environment.

In order to attenuate the noise generated by the pulsing flow, acoustic dampening systems (acoustic filters) have been used. These systems may be classified as dissipative and reactive systems. The dissipative dampening systems absorb sound energy, but create an undesirable pressure loss. On the other hand, the reactive mufflers tend to reflect part of the sound energy, thereby reducing pressure loss. The dissipative mufflers are more used in discharge dampening systems, where the pulsation is high. The reactive systems are preferred for the suction, since they present less pressure loss. Said pressure loss in the acoustic filters is one of the causes that reduce the efficiency of the compressors, mainly in the suction case, which is more sensible to the pressure loss effects.

Other cause that reduces the efficiency of the compressors, when usual acoustic mufflers are employed, is the overheating of the suctioned gas. During the time interval between the entrance of the gas into the compressor and its admission to the compressor cylinder, the gas temperature is increased, due to heat transfer from the several hot sources existing inside the compressor. The temperature increase causes an increase in the specific volume and consequently a reduction in the refrigerant mass flow. Since the refrigerating capacity of the compressor is directly proportional to the mass flow, reducing said flow results in efficiency loss.

Reducing these negative effects has been achieved with the evolution in the acoustic filter designs. In prior constructions, the gas coming from the suction line and discharged into the shell passes through the main hot sources inside the compressor, before reaching the filter and being drawn towards the cylinder inside (indirect suction). This gas circulation should promote the cooling of the motor. Because of this and because the filters were usually metallic, the efficiency of the compressor was impaired due to gas overheating.

The requirements for more efficient compressors have led to the development of acoustic dampening systems with more efficient conceptions. The gas, rather than passing through all heated parts inside the compressor, is drawn directly to the inside of the suction filter (U.S. Pat. No. 1,591,239, U.S. Pat. No. 4,242,056). Other technique uses, in the suction piping inside the compressor, nozzles or flared tubes (U.S. Pat. No. 4,486,153), which allow the flow to be directed between the inlet tube and the suction filter. Moreover, such filters began to be manufactured with plastic materials, which have adequate thermal insulating properties. These improvements brought about considerable increases in the efficiency of the refrigerating hermetic compressors. Nevertheless, overheating and load loss due to the use of the suction filter still represent significant amounts in the efficiency losses of the compressors.

In the known reciprocating hermetic compressors of the art, the gas coming from the evaporator enters into the shell and then passes through the suction filter, wherefrom it is drawn to the inside of the cylinder defined in the cylinder block, where it is compressed up to a pressure sufficient to open the discharge valve. Upon being discharged, said gas passes through the discharge valve and discharge filter, leaving the compressor inside and leading towards the condenser of the refrigerating system. In this type of compressor, the discharge filter is always hermetic, i.e., the gas is not released into the shell inside, whereas the suction filter is in fluid communication with said shell inside.

DISCLOSURE OF THE INVENTION

Thus, it is an object of the present invention to provide a reciprocating hermetic compressor with a suction arrangement which presents, besides less suction gas heating, a reduction of pressure loss associated with the suction filter.

This and other objectives are achieved through a suction arrangement for a reciprocating hermetic compressor of the type including a hermetic shell comprising a suction inlet tube for admitting gas into the shell; a suction orifice, which is provided at the head of a cylinder disposed inside the shell and which is in fluid communication with the suction inlet tube, said arrangement comprising a suction means having a first end hermetically coupled to the suction inlet tube and a second end hermetically coupled to the suction orifice, in order to conduct low pressure gas from the suction inlet tube directly to the suction orifice, providing thermal and acoustic insulation to the gas flow being drawn; and at least one pressure equalizing means, providing a predetermined fluid communication of the gas being drawn between the suction inlet tube and suction orifice into the shell, said pressure equalizing means maintaining substantially unaltered the thermal and acoustic insulating characteristics of the suction means.

BRIEF DESCRIPTION OF THE DRAWINGS

The invention will be described below, with reference to the attached drawings, in which:

FIG. 3 shows, schematically and in a partial view, a reciprocating hermetic compressor, associated with a refrigerating system according to one constructive form of the present invention;

FIG. 4 shows, schematically and in a partial view, a reciprocating hermetic compressor, associated with a refrigerating system according to another constructive form of the present invention;

FIG. 6 shows, schematically and in a frontal view, a constructive form for the suction means of the present invention;

BEST MODE OF CARRYING OUT THE INVENTION

According to the illustrations, a refrigerating system of the type used in refrigerating appliances usually comprise, connected by adequate piping, a condenser 10, which receives high pressure gas at the high pressure side of a hermetic compressor 20 of the reciprocating type and which sends high pressure gas to a capillar tube 30, where the refrigerant fluid is expanded, communicating with an evaporator 40 which sends low pressure gas to a low pressure side of the hermetic compressor 20.

Figure 1:
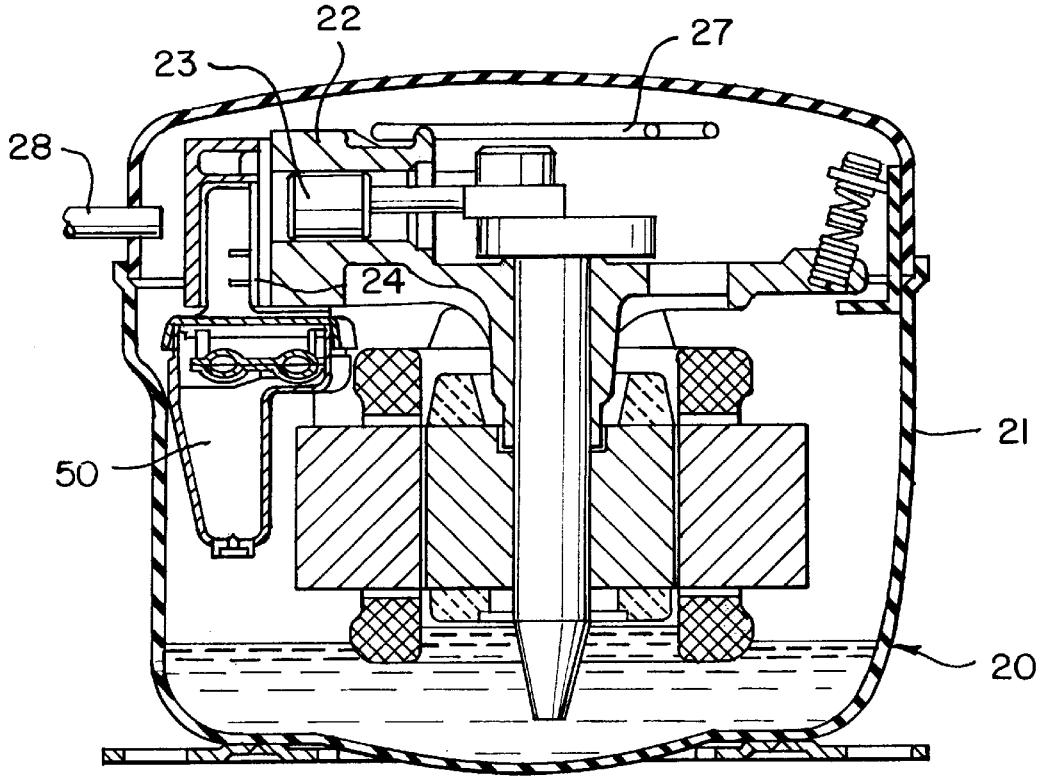
FIG. 1 PRIOR ART
FIG. 1 shows, schematically and in a vertical longitudinal sectional view, a reciprocating hermetic compressor of the type used in refrigerating systems and constructed according to the prior art.

According to FIG. 1 as shown, the hermetic compressor 20 comprises a shell 21, inside which is suspended through springs a motor-compressor unit including a cylinder block, in which a cylinder 22 lodges a piston 23 that reciprocates within said cylinder 22, drawing and compressing the refrigerant gas when driven by the electric motor. Said cylinder 22 has an open end, which is closed by a valve plate 24 affixed to said cylinder block and provided with suction and discharge orifices. Said cylinder block further carries a head which is mounted onto said valve plate 24 and which defines internally therewith a suction chamber 25 and a discharge chamber 26, which are maintained in selective fluid communication with cylinder 22, through the respective suction and discharge orifices 24*a*, 24*b*. Said selective communication is defined by opening and closing said suction and discharge orifices 24*a*, 24*b* by the respective suction and discharge valves 25*a*, 26*a*. By suction chamber it is meant only the volume of the cylinder head upstream the suction valve 25*a*.

The communication between the high pressure side of the hermetic compressor 20 and the condenser 10 occurs through a discharge tube 27 having an end, which is opened to an orifice provided on the surface of shell 21, communicating said discharge chamber 26 with condenser 10, and an opposite end, which is opened to the discharge chamber 26.

Shell 21 further carries a suction inlet tube 28, mounted to an admission orifice which is provided at shell 21 and opened to the inside of the latter, communicating with a suction piping located externally to shell 21 and coupled to the evaporator 40. In this construction, the gas coming from shell 21 is admitted inside a suction acoustic filter 50 mounted in front of the suction chamber 25, in order to dampen the noise of the gas being drawn into cylinder 22 during the opening of the suction valve. This construction has the deficiencies discussed above.

According to the present invention, as illustrated in FIGS. 3 and 6, between the evaporator 40 and the inside of suction chamber 25 of the hermetic compressor 20, there is mounted, interconnecting said parts, a suction means 60, which is provided within shell 21 and which comprises, at least on a portion of its length, a suction duct, in flexible material for instance, having a first end 61 coupled to the suction inlet tube 28 and a second end 62 coupled to a gas inlet portion of the suction chamber 25, said suction duct 60 being hermetically affixed to both suction inlet tube 28 and suction chamber 25, so as to conduct low pressure gas from the evaporator 40 directly to said suction chamber 25, providing thermal and acoustic insulation of the gas being drawn in relation to the internal environment of the compressor. In another constructive option of the present invention, the second end 62 of the suction duct 60 communicates the gas being drawn directly to cylinder 22, for example with said second end 62 being hermetically and directly coupled to the suction orifice 24*a*.

According to the present invention, the hermetic compressor 20 no longer has the suction acoustic filter 50 within shell 21. In a constructive option as illustrated in FIG. 4, the suction acoustic filter 50 is mounted upstream the suction inlet tube 28. Mounting the filter externally to shell 21 allows filters with higher volume and tubes with larger diameters to be used, while still providing the same acoustic dampening effect with less pressure loss. Since the refrigerating capacity is proportional to the suction pressure, the less said loss, the higher will be the compressor efficiency. This filter arrangement prevents the gas, while passing through the inside of said filter, from being unduly heated as it occurs in the prior art construction.

According to the present invention, the suction duct 60 is designed so as to be preferably produced as a continuous tubular duct, which is constructed, in order to avoid interruption of the gas flow being drawn, in an adequate material which causes minimum noise and vibration transmission to shell 21 and which further avoids gas overheating during the admission thereof. In order to have these qualities, the suction duct 60 is obtained with a construction that offers high resistance to heat transmission, such as for example the constructions using a material with low conductivity characteristic (poor thermal conductors), which also have good acoustic dampening characteristics.

The requirement of suction piping flexibility is due to the relative movement existing between the mechanical assembly and the shell 21, since the mounting of said parts is made through flexible springs. The flexibility will prevent said piping from being broken during transportation or even during normal operation of the compressor.

The suction duct 60 is further dimensioned in order to minimize the noise generated by the pulsing flow resulting from the excitement of both the suction line piping and the evaporator 40, and in order to reduce loss of load of the gas flow coming from the suction inlet tube 28 and consequently to the suction chamber 25 or directly to the suction orifice 24*a*.

Due to the characteristics of the gas flow, smaller length and larger diameter of the suction duct 60 inside the compressor, there will be less pressure loss in relation to the pressure loss existing in the suction filter used in the prior art.

Using the suction duct 60 causes a reduction of the path made by the gas inside the shell, previously to being admitted into the cylinder. By reducing the path, the overheating effect of the gas being drawn is smaller, which increases the refrigerating capacity and efficiency.

Figure 5:
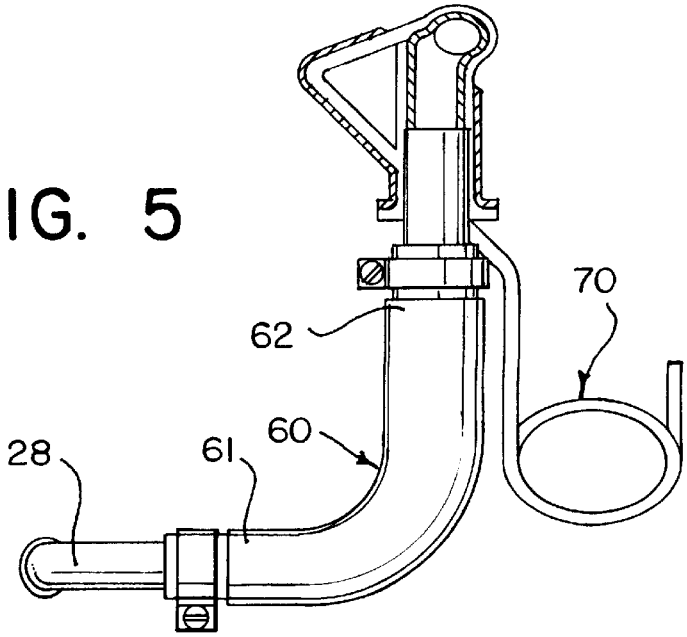
FIG. 5 shows, schematically and in an enlarged view, a construction of the suction means mounted to both the suction inlet tube and suction chamber inlet of the compressor shell, and a pressure equalizing means mounted to the assembly.
Figure 2:
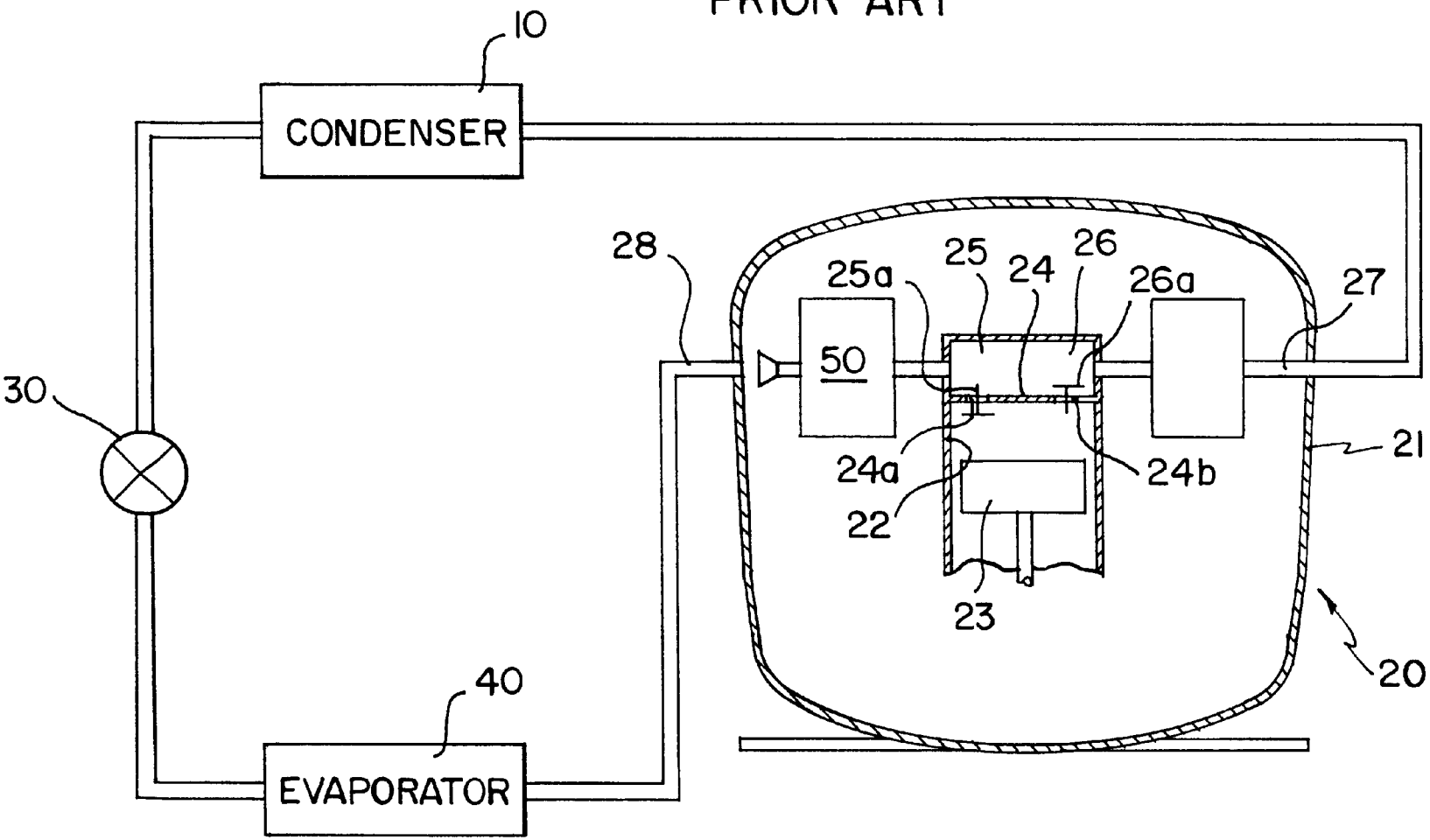
FIG. 2 PRIOR ART
FIG. 2 shows, schematically, a reciprocating hermetic compressor, associated with a refrigerating system according to the prior art.

In a constructive option of the present invention for the suction means 60, as illustrated in FIGS. 5 and 6, said means is in the form of a loop tube, which is "U" shaped with rounded sides and internally provided with or incorporating (for example by material injection) at least one spring element 63 which constantly mantains said tube in a condition of structural stability, in order to prevent it from collapsing when submitted to pressure differences, such as during the compressor operation.

According to the present invention, as illustrated in FIGS. 4 and 5, between the suction inlet tube 28 and suction chamber 25, the suction arrangement of the present invention further comprises a pressure equalizing means 70 which preferably provides a predetermined fluid communication between the inside of the suction chamber 25 and the inside of shell 21, said pressure equalizing means 70 being dimensioned so as to promote jointly with the suction means 60 the acoustic energy absorption of the gas being drawn.

In the constructive option in which the second end 62 of the suction means 60 is directly coupled to the suction orifice 24*a*, the pressure equalizing means 70 is provided between the suction inlet tube 28 and said suction orifice 24*a*, in order to provide fluid communication of the gas being drawn with the inside of shell 21.

The pressure equalizing means 70 may be further dimensioned and constructed in order to provide thermal insulation, as it occurs with the suction means 60.

In the preferred illustrated construction, the pressure equalizing means 70 is in the form of a rigid capillar tube, which has a small diameter and long length and which comprises, between an inlet end, attached to and opened into the suction chamber 25, and an outlet end to release the gas into the inside of shell 21, an acoustic dampening region 71, for instance in the form of a median helical portion occupying a substantial length portion of the pressure equalizing means 70, said length portion being defined so as to reduce the acoustic energy of the suction gas directed to the inside of shell 21. The pressure equalizing means 70 further allows to obtain a pressure inside said shell 21 substantially proximate to the suction pressure.

According to the present invention, the low pressure gas released inside shell 21 through the pressure equalizing means 70 causes a high gas flow restriction, so that the acoustic waves originated at the outlet of said pressure equalizing means have very low energy, which is insufficient to excite the ressonances inside the cavity.

Though not illustrated, the suction arrangement of the present invention may have a plurality of pressure equalizing means coupled or incorporated to at least one of the parts defined by the suction duct 60 and suction chamber 25. Other constructive solutions of the present invention have a pressure equalizing means with a plurality of at least one of the parts defined by the inlet ends and outlet ends interconnected by one or more acoustic dampening regions 71.

What is claimed is:

1. A suction arrangement for a reciprocating hermetic compressor comprising:

a hermetic shell;

a suction inlet tube for admitting gas into the shell;

a suction orifice at the head of a cylinder disposed inside the shell and which is in fluid communication with the suction inlet tube;

a suction means having a first end hermetically coupled to the suction inlet tube and a second end hermetically coupled to the suction orifice for conducting low pressure gas from the suction inlet tube directly to the suction orifice, providing thermal and acoustic insulation to the gas flow being drawn; and at least one pressure equalizing means for providing a predetermined fluid communication of the gas being drawn between the suction inlet tube and suction orifice into the shell, the thermal and acoustic insulating characteristics of the suction means maintained substantially unaltered by the pressure equalizing means.

2. The suction arrangement, as in claim 1, wherein said pressure equalizing means has on a portion of its length at least one acoustic dampening region to reduce the acoustic energy in the suction gas inside of said shell.

3. The suction arrangement as in claim 2 wherein said pressure equalizing means comprises a capillary tube.

4. The suction arrangement, as in claim 3, wherein said pressure equalizing means comprises a capillary element of a rigid material with a gas inlet end coupled to the suction chamber and a gas outlet end opened to the inside of said shell.

5. The suction arrangement, as in claim 4, wherein said acoustic dampening region comprises a helical portion of the length of said pressure equalizing means.

6. The suction arrangement, as in claim 2, wherein said suction means is provided on part of its extension with an element having high resistance to heat transmission.

7. The suction arrangement, as in claim 6, wherein said suction means includes a flexible duct on part of its extension.

8. The suction arrangement, as in claim 7, wherein said flexible duct is of a material having low thermal conductivity.

9. The suction arrangement, as in claim 8, wherein said suction duct has an internal cross-section dimensioned to reduce the load loss of the gas flow arriving at the suction inlet tube.

10. The suction arrangement, as in claim 9, wherein said suction duct provides a continuous flow of the gas flowing between the suction inlet tube and the suction orifice.

11. The suction arrangement, as in claim 10, wherein the second end of the suction means is hermetically and directly coupled to the suction chamber.

12. The suction arrangement, as in claim 11, wherein said suction duct comprises a U-shaped "loop" having rounded sides, and which is internally provided with at least one spring element to maintain a condition of structural stability of said tube.

13. The suction arrangement, as in claim 2, further comprising a suction acoustic filter mounted upstream of said suction inlet tube.

14. The suction arrangement, as in claim 2, wherein said pressure equalizing means further comprises an acoustic dampening region between a gas inlet end and a gas outlet end opened to the inside of said shell.

* * * * *